US005725365A

United States Patent [19]

Solomon et al.

[11] Patent Number: 5,725,365

[45] Date of Patent: Mar. 10, 1998

[54] ROLLING DIAPHRAGM SEAL ARRANGEMENT FOR A SUBMERSIBLE PUMP SYSTEM

[76] Inventors: Fred D. Solomon, 979 Meadow Park Dr.; Charles S. Solomon, 604 Lois Dr., both of Akron, Ohio 44333; Dale F. Solomon, 730 Pin Oak Dr., Wadsworth, Ohio 44281

[21] Appl. No.: 571,198

[22] Filed: Dec. 12, 1995

[51] Int. Cl.[6] ..... F04B 53/12

[52] U.S. Cl. ..... 417/552; 417/545; 92/98 D

[58] Field of Search ..... 92/98 D; 417/545, 417/549, 552, 554

[56] References Cited

U.S. PATENT DOCUMENTS

| | | | |
|---|---|---|---|
| 3,327,633 | 6/1967 | Duinker et al. | 92/98 D |
| 3,620,652 | 11/1971 | Jaspers et al. | 417/550 |
| 3,673,927 | 7/1972 | Fluhr | 92/98 D |
| 3,835,714 | 9/1974 | Van Der AA et al. | 92/98 D |
| 4,024,770 | 5/1977 | Liesenborghs | 92/98 D |
| 4,036,112 | 7/1977 | Hubschmann | 92/98 D |
| 4,773,305 | 9/1988 | Nissels | 92/98 D |

FOREIGN PATENT DOCUMENTS

| | | | |
|---|---|---|---|
| 1416753 | 8/1988 | U.S.S.R. | 417/554 |
| 1613676 | 12/1990 | U.S.S.R. | 417/549 |
| WO 82/03246 | 9/1982 | WIPO | 92/98 D |

*Primary Examiner*—Charles G. Freay
*Assistant Examiner*—Peter G. Kurytnyk
*Attorney, Agent, or Firm*—Renner, Kenner, Greive, Bobak, Taylor & Weber

[57] ABSTRACT

A submersible pump cylinder (10; 110) for immersion in and displacement of a fluid (W), including a cylindrical housing (20; 120), a plunger assembly (45; 145) positioned for reciprocating motion within the cylindrical housing, a sealing sleeve assembly (85; 185) attached to the cylindrical housing and to the plunger assembly and overlapped to maintain a convolution (90; 190; 190') which moves during the reciprocating motion of said plunger assembly, and a balance valve (55) associated with the plunger assembly maintaining pressure within the flexible sleeve, whereby the flexible sleeve is maintained in engagement with the housing and the plunger assembly and substantially without frictional interengagement during motion of the plunger assembly.

24 Claims, 7 Drawing Sheets

ROLLING DIAPHRAGM SEAL ARRANGEMENT FOR A SUBMERSIBLE PUMP SYSTEM

TECHNICAL FIELD

The present invention relates generally to a submersible pump cylinder. More particularly, the present invention relates to a pump mechanism which has an improved cylinder adapted to be submersed in a body of fluid. More specifically, the present invention relates to a submersible pump cylinder which has a cylinder that employs a sealing mechanism to interconnect a housing and a plunger to provide highly advantageous pumping efficiency and improved wear characteristics of the sealing mechanism.

BACKGROUND ART

Pumps have been employed for many years to transport water from subsurface water-beating layers, which may lie at substantial depths below the surface of the ground, to ground level to provide a water supply for people, animals, irrigation, and other purposes. Windmills were devised long ago to utilize wind energy to supply the motive power for well pumps as a replacement in substantial pan for manually-operated lifts suspending water containers, such as buckets and the like. For many years and even to the present time, windmills remain the only viable option as a power source in many areas of the world where electrical power is not available to drive motors to supply the motive force for powering well pumps. Even in areas where electric power is available, it is common to employ pumps which are primarily, or exclusively, driven by windmills due to the energy savings which is realized by taking advantage of naturally-occurring wind forces. Thus, windmills remain an advantageous source of energy for driving well pumps due to their operating capability where electric power does not exist and due to their capability for saving electrical energy even where electric power is available to drive pump motors.

Windmills have to the present time suffered from significant disadvantages which limit their operational characteristics in various respects. Under relatively low, intermittent, or fluctuating wind conditions, windmills are often rendered inoperative. This is due in substantial part to the fact that pump cylinders for wells are notoriously inefficient. The inefficiency is due to the construction of the well cylinders, which is essentially in accordance with technology dating back many years.

Typically, the cylinders have various types of ball valves or spool poppet-type valves which cycle in a well-known fashion to draw water into the cylinder casing while the plunger displaces water up the drop pipe of the well. Thereafter, the plunger moves through water drawn into the cylinder on the downstroke preparatory to a further upstroke. Plungers are sealed relative to the cylinder casing by conventional O-rings or U-cups. In order to achieve an effective seal, the O-rings or U-cups must be compressed to a substantial extent to operate effectively, particularly in the higher pressures extant in deep wells. As a result, these seals tend to wear rapidly to such an extent that they become less efficient in a matter of months, thus, normally requiring removal of the cylinder from the well and replacement of the seals yearly or more frequently in order to maintain a reasonable measure of efficiency. The replacement of seals on a well cylinder plunger is a significant problem due to the necessity for pulling the cylinder from the well, replacing the seals, and restoring the cylinder to its position in the well casing. In instances of deep wells and larger diameter cylinders, it is necessary to employ heavy equipment which must be brought to the well site for purposes of pulling a well cylinder and replacing the sealing members. Thus, considerable cost in terms of equipment and labor is involved in replacing the plunger seals, above and beyond the cost of the seals themselves.

Historically, the seals in well cylinders were made of leather; however, leather is recognized as a material which can harden and result in increased friction, which intensifies wear, particularly in the water environment of a well. Attempts have been made to fabricate seals from softer and/or smoother, slicker materials for purposes of reducing friction and thereby reducing wear. Such materials have, however, been largely unsuccessful in well cylinder applications because dirt and other foreign material can readily become embedded in softer materials, which results in scratching and eventually etching of the cylinder casing walls, which are, in many instances, fabricated of brass to withstand the well environment but suffer the disadvantage of being relatively soft and prone to scratching and etching damage. Even more expensive repairs are involved in replacing the liner in a well cylinder. As a result, a plurality of leather U-cups or O-rings remain the predominant sealing members for well cylinders to the present time, despite the operating and wear limitations.

DISCLOSURE OF THE INVENTION

Therefore, an object of the present invention is to provide a submersible pump cylinder which is operable in wells or other fluid environments over long periods of time without the necessity for the repair or replacement of components thereof. Another object of the invention is to provide such a cylinder which operates under extremely low friction conditions, such that the sealing member is subjected to only minimal wear and operates with a high efficiency in terms of delivering fluid at greater efficiency than comparable cylinders while possessing the capability of maintaining operation under conditions where the cylinder rod is operated with only minimal drive force. A further object of the present invention is to provide such a cylinder which obviates the disadvantages of prior pump cylinders in pressurized environments, such as deep wells.

Another object of the present invention is to provide a submersible pump cylinder having a flexible sleeve as the sealing member which interconnects the housing and the plunger. A further object of the invention is to provide such a cylinder wherein a flexible sealing member is employed which is of an annular configuration that is overlapped to form a convolution between the housing and the plunger elements to which the sleeve is attached. Another object of the present invention is to provide such a flexible sleeve which is of an annular configuration with a uniform diameter to facilitate ease of manufacture and installation in a pump cylinder. Yet another object of the invention is to provide such a flexible sleeve that has an elastomeric exterior coating to withstand a fluid environment and that has suitable interior fabric cords to provide suitable reinforcing strength while being laid up in a manner which permits the sleeve to roll in overlapping relation with a small convolution.

Another object of the present invention is to provide a submersible pump cylinder having a flexible sleeve of uniform annular dimensions throughout its length, which can be rolled upon itself to form a convolution that moves with displacement of one end of the sleeve relative to the other end. Yet a further object of the invention is to provide such a flexible sleeve wherein one end may be attached internally of a pump housing, and the other end may be attached to a plunger of lesser diameter than the housing, with fluid present on both sides of the flexible sleeve. Still a further object of the invention is to provide such a flexible sleeve wherein the fluid present within the looped sleeve is maintained at a pressure exceeding the pressure of the fluid residing exteriorly of the sleeve. Still another object of the invention is to provide such a flexible sleeve wherein a valve arrangement balances the fluid pressure within the flexible sleeve to maintain the requisite pressure differential, such that spaced portions of the sleeve do not frictionally interengage as a result of the sleeve being pressure forced into contact with the inside of the housing and the exterior surface of the plunger.

A further object of the invention is to provide a submersible pump cylinder having a flexible sleeve sealing member wherein the plunger stroke may be of any desired length, with the flexible sleeve being of comparable length totally independent of the diameter of the cylinder housing. Yet a further object of the invention is to provide a submersible pump cylinder which may use conventional check valves of the type commonly used in such pumps and is otherwise adapted for long-term operation in a fluid environment. Yet another object of the present invention is to provide a submersible pump cylinder as aforesaid which readily achieves extended wear and higher operating efficiencies, while being relatively inexpensive to manufacture.

In general, the present invention contemplates a submersible pump cylinder for immersion in and displacement of a fluid including a cylindrical housing, a plunger assembly positioned for reciprocating motion within the cylindrical housing, a flexible sleeve attached to the cylindrical housing and to the plunger assembly and overlapped to maintain a convolution which moves during the reciprocating motion of the plunger assembly, and a balance valve associated with the plunger assembly maintaining pressure within the flexible sleeve, whereby the flexible sleeve is maintained in engagement with the housing of the plunger assembly and substantially without frictional interengagement during motion of the plunger assembly.

PREFERRED EMBODIMENT FOR CARRYING OUT THE INVENTION

Figure 1:
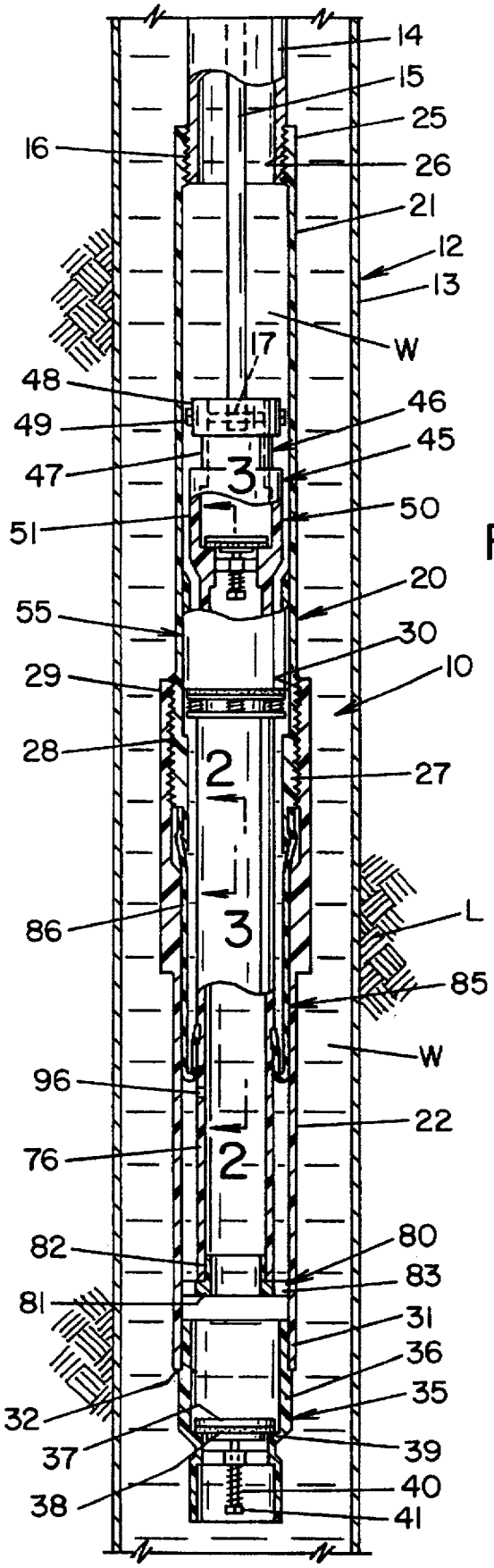
FIG. 1 is a fragmentary longitudinal cross-sectional view of a lower portion of a well showing a pump cylinder according to the concepts of the present invention, operatively attached to a drop pipe and a pump rod and positioned within a well casing.

A submersible pump cylinder embodying the concepts of the present invention is generally indicated by the numeral 10 in FIG. 1 of the drawings. The pump cylinder 10 is shown in a well, generally indicated by the numeral 12, as an exemplary fluid environment. As conventional components, the well 12 has a tubular well casing 13 which extends from the surface of the ground downwardly, normally through a plurality of layers of the earth to, or preferably to substantially the bottom of, a water-bearing layer L. Disposed within and substantially concentrically of the well casing 13 is a conventional drop pipe 14. The drop pipe 14 extends from the well top at the surface of the ground to a position proximate the lower extremity of the well casing 13. Disposed within the drop pipe 14 is a pump rod 15 which similarly extends from the well top at the surface of the ground a distance below the drop pipe 14 within the casing 13. The pump rod 15 is connected in a conventional manner by suitable gearing (not shown) to an electric motor (not shown) or to the pump pole of a windmill (not shown) to produce a desired reciprocating vertical stroke of the pump rod 15 relative to drop pipe 14 and casing 13 to define the stroke of the pump cylinder 10. The aforedescribed components are all standard elements of the exemplary well 12.

Figure 2:
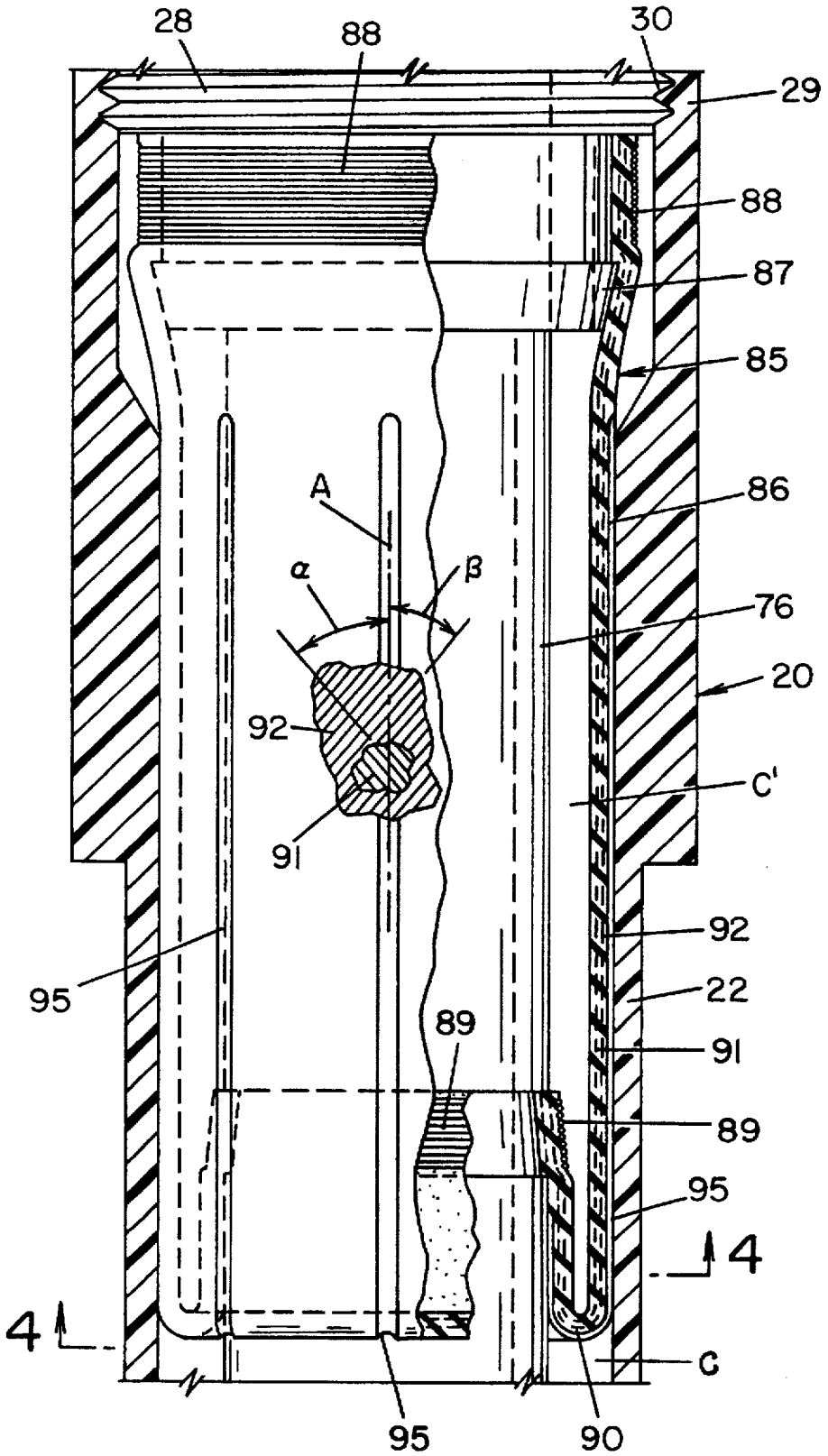
FIG. 2 is an enlarged fragmentary cross-sectional view of the pump cylinder of FIG. 1 taken substantially along the line 2—2 of FIG. 1 and showing details of the construction of the sealing assembly and its attachment to the housing and the plunger assembly.
Figure 3:
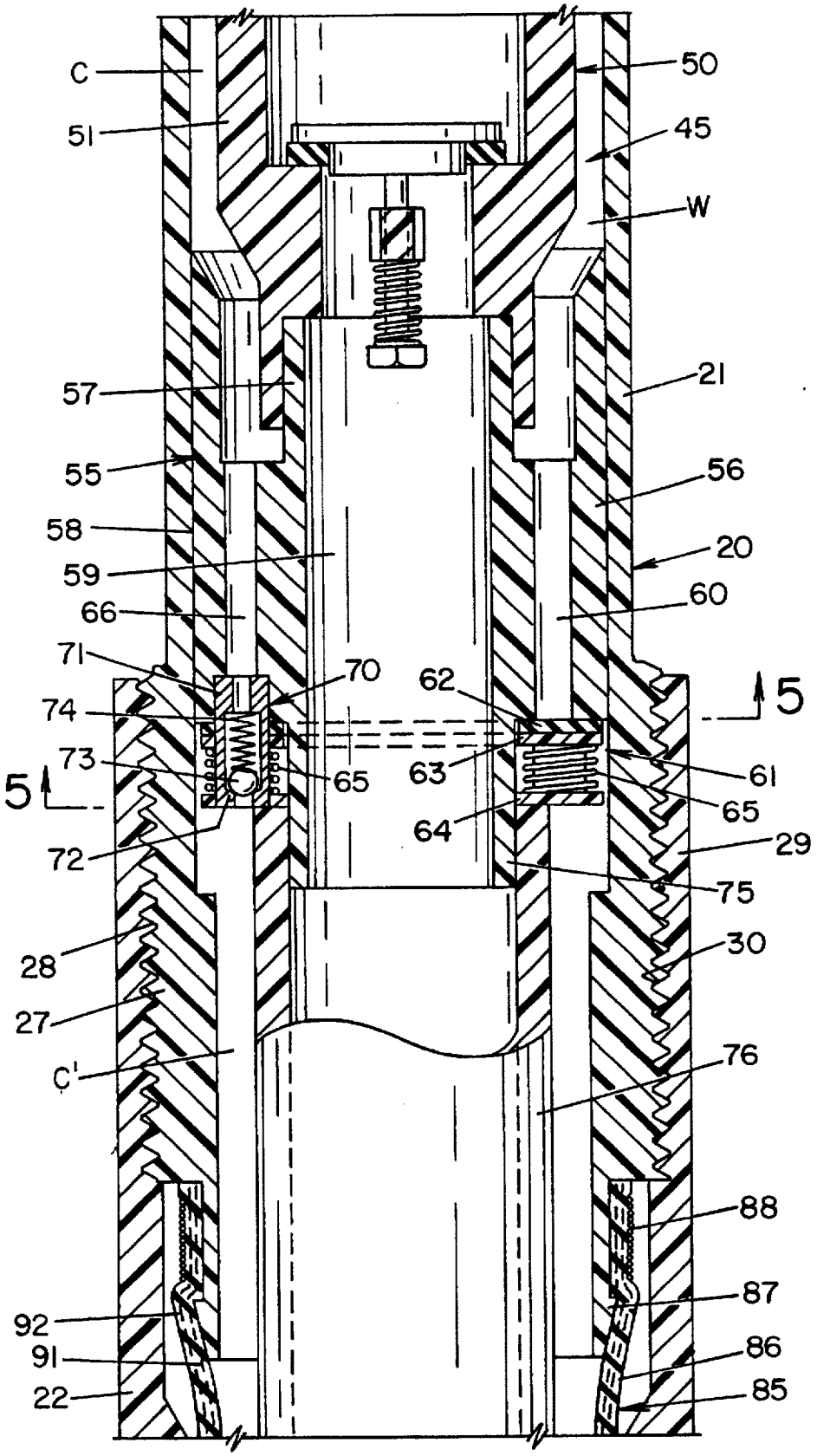
FIG. 3 is another enlarged fragmentary cross-sectional view of the pump cylinder of FIG. 1 taken substantially along the line 3—3 of FIG. 1 and showing details of valving elements associated with the plunger assembly

Referring now to FIGS. 1–3 of the drawings, the pump cylinder 10 has as the external member thereof an elongate annular housing, generally indicated by the numeral 20. The housing 20 consists of an upper cylinder barrel 21 and a lower cylinder barrel 22.

The upper cylinder barrel 21 is attached proximate its upper end 25 to the lower extremity of drop pipe 14 as by internal threads 26 which engage mating external threads 16 proximate the lower extremity of drop pipe 14. The upper cylinder barrel 21 has a lower end 27 which has external threads 28. For purposes of forming the upper cylinder barrel 21 and lower cylinder barrel 22 into an integral but selectively separable housing 20, the lower cylinder barrel 22 has proximate its upper end 29 internal threads 30 adapting to matingly engage the external threads 28 at the lower end 27 of upper cylinder barrel 21. This threaded interconnection of upper cylinder barrel 21 and lower cylinder barrel 22 permits disassembly of housing 20 for purposes of repair or replacement of internal components, as well as subsequent reassembly of the housing 20. The lower end 31 of the lower cylinder barrel 22 terminates in a circular opening 32.

The lower end of housing 20 and particularly lower cylinder barrel 22 is selectively opened and blocked by a lower check valve assembly, generally indicated by the numeral 35. As shown, the lower check valve assembly 35 has a housing 36 which telescopes within the circular opening 32 at the lower end 31 of the lower cylinder barrel 22. Interiorly of the housing 36 is a disk element 37 carrying a sealing element 38 which engages a valve seat 39 in the housing 36. The disk element 37 is normally biased to the closed position depicted in FIG. 1 of the drawings by the spring 40 disposed about the shaft 41 projecting from disk element 37. The spring 40 operates to bring disk element 37 to the closed position in the absence of flow through the lower check valve assembly 35. It will be appreciated by persons skilled in the art that a wide variety of spool, ball, and other types of check valves may be employed to carry out the functions of the lower check valve assembly 35.

Positioned within and movable relative to the housing 20 is a plunger assembly, generally indicated by the numeral 45 in FIG. 1 of the drawings. The plunger assembly 45 is movable relative to housing 20 by virtue of attachment to the pump rod 15 of the well 12. The uppermost element of plunger assembly 45 is a hollow annular connector, generally indicated by the numeral 46. The connector 46 has a tubular body 47 with an enlarged sleeve 48 which has a diametrically disposed pin 49 that engages a bore 17 in the pump rod 15 to thereby attach connector 46 to the pump rod 15 for vertical reciprocating motion therewith.

The plunger assembly 45 has an upper check valve assembly 50 having a housing 51 which receives the tubular body 47 of connector 46 and is affixed thereto as by an adhesive. The upper check valve assembly 50 may be otherwise identical to and biased in the manner of the lower check valve assembly 35. Positioned below the upper check valve assembly 50 on the plunger assembly 45 is a combined balance valve and bearing, generally indicated by the numeral 55. As best seen in FIG. 3, the combined balance valve and bearing 55 is a generally annular elongate tube 56 having a flange 57 which extends into and is secured, as by an adhesive, in the housing 51 of the upper check valve assembly 50. The tube 56 has an outer bearing surface 58 which has a limited clearance of a few thousandths of an inch with respect to the inner surface of the upper cylinder barrel 21 for purposes of centering the upper portion of plunger assembly 45 within the housing 20 during reciprocating motion therein. In addition, the clearance is sufficient to permit water to pass between outer bearing surface 58 and upper cylinder barrel 21 but with the tube 56 being of a sufficient axial length such that appreciable resistance is developed to the passage of fluid therebetween.

The combined balance valve and bearing 55 has a central bore 59 through which water W within housing 20 may pass. It is to be noted that the outer surface of the housing 51 of upper check valve assembly 50 is substantially smaller than the inner diameter of upper cylinder barrel 21, such that water W may freely flow in the annular channel C there formed.

Figure 5:
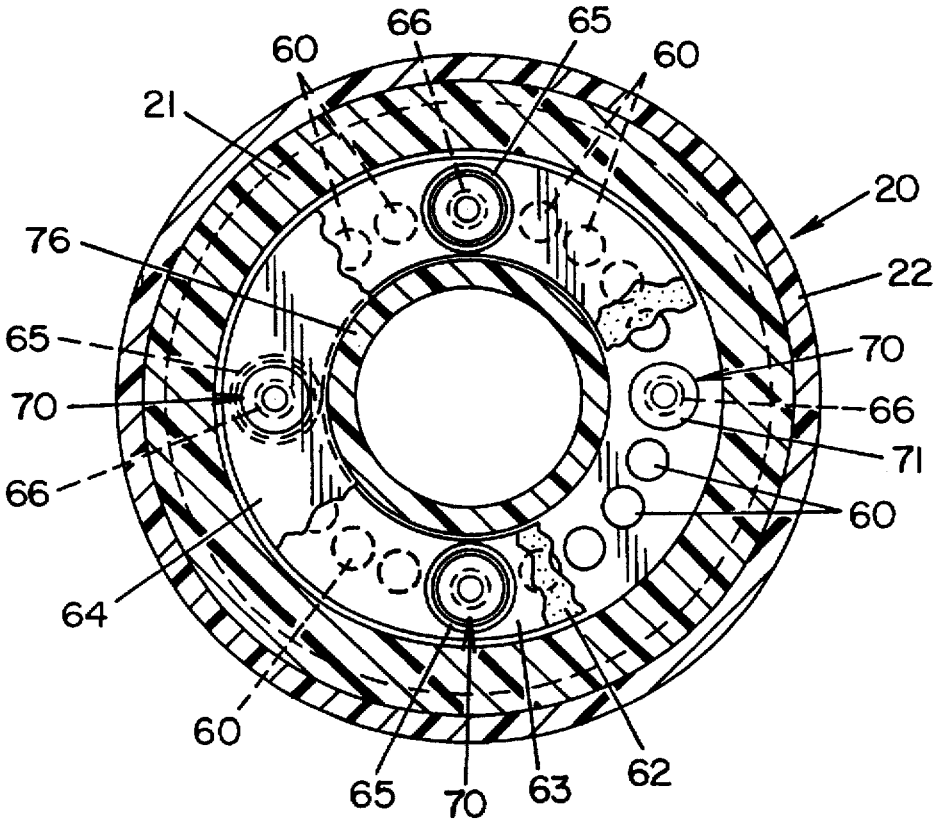
FIG. 5 is a cross-sectional view taken substantially along the line 5—5 of FIG. 3 showing further details of the positioning and construction of the valving elements associated with the plunger assembly.

In addition to the central bore 59, water W is selectively passed through combined balance valve and bearing 55 from annular channel C to the annular channel C' therebelow via a plurality of throughbores 60. As best seen in FIGS. 3 and 5, there are four groupings of four throughbores 60, for a total of twelve throughbores 60. The throughbores 60 are sized such that there is a free flow of water W from annular channel C to annular channel C' when the plunger assembly 45 moves upwardly in the housing 20. The flow of water W via throughbores 60 is precluded during motion of the plunger assembly 45 downward in housing 20 by a plurality of flapper valves, generally indicated by the numeral 61, operative in relation to each of the throughbores 60. The flapper valves 61 consist of an annular, elastomeric sealing member 62 which overlies each of the throughbores 60. An annular backing plate 63 of substantially the same dimensions is positioned just below the annular, elastomeric sealing member 62. Spaced from the backing plate 63 is an annular, fixed stop block 64. A compression spring 65 is interposed between the stop block 64 and annular backing plate 63 for purposes of normally biasing the annular, elastomeric sealing member 62 into position blocking the throughbores 60 such as to preclude the flow of water W into throughbores 60 during downstroke of the plunger assembly 45. It is to be appreciated that the compression springs 65 operate to merely effect placement of the annular, elastomeric sealing member 62, such that their force is easily overcome with the annular, elastomeric sealing member 62 readily moving away from the throughbores 60 upon the institution of upstroke movement of the plunger assembly 45.

The combined balance valve and bearing 55 also has a plurality of relief ports 66 which extend axially therethrough. As best seen in FIGS. 3 and 5, the relief ports 66 each contain relief valves, generally indicated by the numeral 70. The relief valves 70 consist of a housing 71 having a valve seat 72 selectively seating a ball 73 urged into engagement therewith by a compression spring 74. It will be readily appreciated by persons skilled in the art that the ball 73 will be positioned against seat 72 to block relief ports 66 during upstroke movement of the plunger assembly 45. Upon downstroke of the plunger assembly 45, the balls 73 move away from the seats 72 to selectively permit the flow of water W from annular channel C' to annular channel C through the relief ports 66. The compression springs 74 are sized and configured to permit passage of water W through relief valves 70 and relief ports 66 when the pressure in annular channel C' reaches a value of approximately 5 psi greater than the head pressure of the water W. Thus, for reasons detailed hereinafter, the pressure in annular channel C' is maintained at or below this 5 psi differential at all times.

The tube 56 of the combined balance valve and bearing 55 has a downwardly projecting flange 75 to which is attached an elongate, annular support tube 76. The support tube 76 receives a lower bearing, generally indicated by the numeral 80, proximate its lower extremity. The lower bearing 80 has an annular body 81 which seats in the extremity of support tube 76 and has a projecting flange 82 that extends into and is attached to the support tube 76. Lower bearing 80 has a plurality of radially outwardly extending, circularly-spaced fins 83 which engage the internal surface of lower cylinder barrel 22. The fins 83 establish a loose fit with respect to the internal surface of lower cylinder barrel 22, such that there is essentially no resistance to vertical movement of lower bearing 80 with vertical movement of support tube 76 while maintaining support tube 76 centered in or in concentric alignment with the lower cylinder barrel 22. It will also be appreciated that water W is permitted to freely pass lower bearing 80, both internally and externally of the support tube 76.

Figure 4:
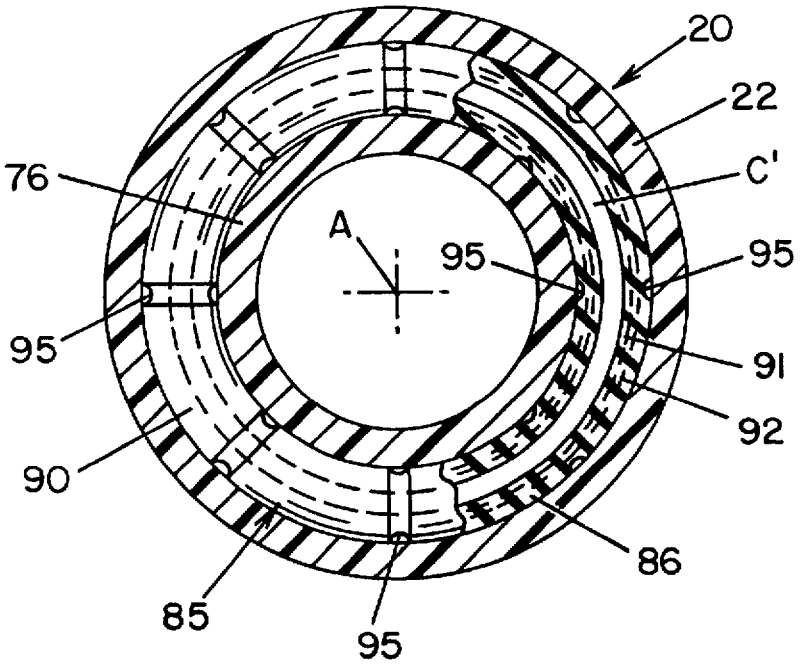
FIG. 4 is a cross-sectional view taken substantially on the line 4—4 of FIG. 2 showing further details of the construction of the sealing assembly.

The flow of water W between the housing 20 and the plunger assembly 45 is precluded by a sealing assembly, generally indicated by the numeral 85. As best seen in FIGS. 1, 2, and 4, the sealing assembly 85 has as a primary component thereof a flexible sleeve 86 which is connected to the housing 20 and the plunger assembly 45. As best seen in FIGS. 2 and 3, the lower end 27 of upper cylinder barrel 21 has a projecting barbed flange 87 over which one end of the flexible sleeve 86 is stretched. Outwardly of the flexible sleeve 86 in the area of barbed flange 87 is a clamp ring 88 which may be of various available types or, as shown, a continuous wire winding. A second clamp ring 89 attaches the other end of the flexible sleeve 86 to support tube 76 after the flexible sleeve 86 has been looped or overlapped in annular channel C' to form a convolution 90 in the flexible sleeve 86. It will be appreciated that the convolution 90 moves longitudinally of flexible sleeve 86 as the plunger assembly 45 strokes upwardly and downwardly relative to the housing 20.

The sealing assembly 85 and particularly flexible sleeve 86 has a number of significant structural characteristics which contribute to a smooth, nearly friction-free operation of the sealing assembly 85. Initially, the flexible sleeve 86 is preferably constructed to have a substantially uniform diameter throughout its length which permits the utilization of a flexible sleeve 86 of any desired axial length to meet any desired stroke length requirements of plunger assembly 45. This is to be distinguished from diaphragm-type sealing members which have a tapered increasing diameter to facilitate overlapping movement but which are severely limited in axial length due to tendencies of the material to wrinkle and thus create severe friction and wear characteristics. In addition, the flexible sleeve 86 must be sufficiently thin, such that it can snugly fit on the support tube 76, yet be stretched over the larger diameter barbed flange 87 of upper cylinder barrel 21. The material thickness must also be sufficiently limited, such that the convolution 90 of flexible sleeve 86 fits within the relatively narrow annular channel C'.

Also material to achieving the operational objectives of the sealing assembly 85 is the construction of the flexible sleeve 86. In that respect, it has been found that flexible sleeve 86 may advantageously be constructed of two layers of reinforcing fabric, with the fibers of the under layer 91 disposed at an angle $\alpha$ of approximately 50 degrees to the longitudinal axis A of flexible sleeve 86 and the fibers of the upper layer 92 disposed at an angle of $\beta$ at approximately 50 degrees to the other side of the longitudinal axis A.

By use of relatively flexible fiber or cord material and the specified weave angle, with the fabric being elastomer coated on both sides, the flexible sleeve 86 may be designed to roll into a small convolution 90, yet possess sufficient strength to preclude wrinkling as the convolution 90 rolls up and down between the housing 20 and support tube 76 during the stroking of the plunger assembly 45.

The outer surface of flexible sleeve 86 preferably has a smooth finish on the elastomer for engagement with the inner surface of lower cylinder barrel 22 and support tube 76. Although the pressure in annular channel C' is, through operation of the combined balance valve and bearing 55, designed to exceed the pressure below flexible sleeve 86 by two to five psi, such condition does not necessarily exist under all operating parameters. During the downstroke of plunger assembly 45 when the stroke speed is relatively slow, as during light or intermittent wind conditions, there may be insufficient pressure in annular channel C', such that water W may be trapped between the inside surface of lower cylinder barrel 22 or the outer surface of support tube 76 and the flexible sleeve 86. As seen in FIGS. 2 and 4, the flexible sleeve 86 is provided on its outer surface with a plurality of circumferentially-spaced, axial grooves 95 extending substantially the entire axial length of flexible sleeve 86. The grooves 95 thus permit any trapped water W to escape to the portion of annular channel C below the flexible sleeve 86, thus preventing distortion which could cause wrinkling or interference between different areas of flexible sleeve 86. As shown, eight equiangularly-spaced grooves 95 are provided in the outer surface of the flexible sleeve 86.

The inside surface of the flexible sleeve 86 may have a minutely-grooved elastomeric surface, which although retaining a relatively smooth, velvety surface, tends to retain water W to serve as a water-bearing surface between overlapped areas of flexible sleeve 86, which may occasionally come into relatively close proximity due to temporary distortions of areas of flexible sleeve 86 caused, for example, by the previously discussed temporary entrapment of water W.

In instances of extremely rapid stroking of plunger assembly 45, conditions may exist where entrained air pockets may be formed in the water W residing in annular channel C below flexible sleeve 86 due to the rush of water W through lower check valve assembly 35 and lower bearing 80. To control this condition, support tube 76 may be provided with one or more small vent holes 96 (see FIG. 1) positioned just below the point of attachment of flexible sleeve 86 to support tube 76. Air can thus escape through vent holes 96 through the central chamber of plunger assembly 45 and upwardly through the drop pipe 14.

Figure 6A:
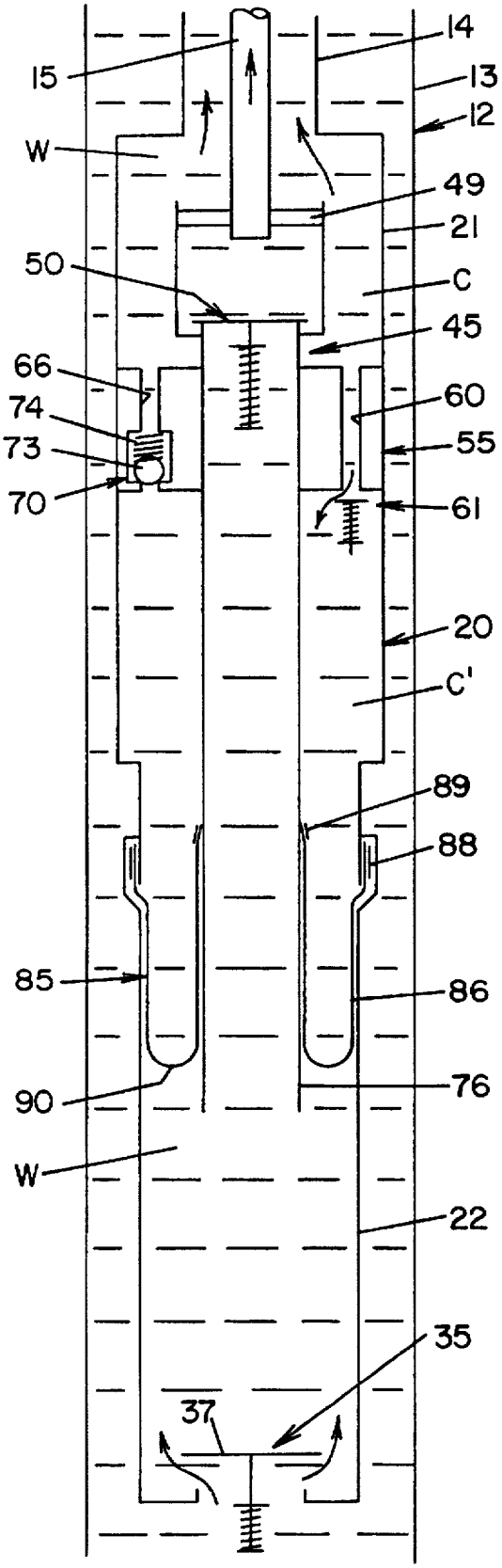
FIG. 6A is a schematic depiction of the pump cylinder of FIG. 1 showing the position of the valving elements during the up stroke of the plunger assembly relative to the housing.
Figure 6B:
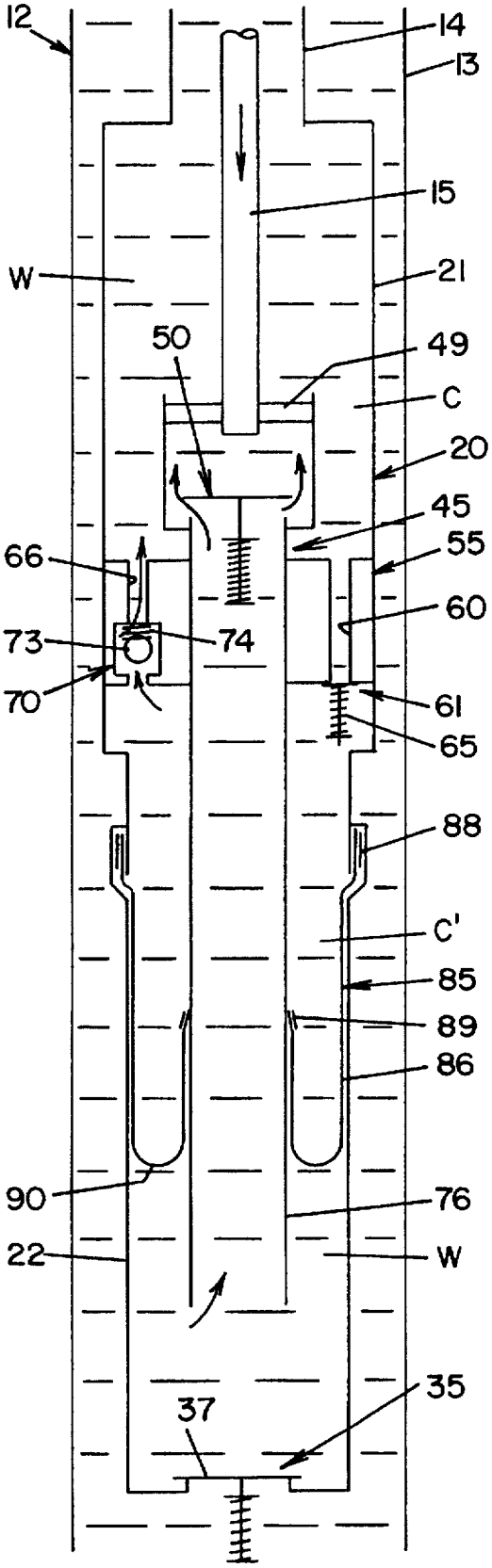
FIG. 6B is a schematic depiction similar to FIG. 6A of a pump cylinder showing the position of the valving elements during the down stroke of the plunger assembly relative to the housing.

The operation of pump cylinder 10 depicted in FIGS. 1–5 is schematically depicted in FIGS. 6A and 6B of the drawings. The position of the valving of pump cylinder 10 during the upstroke of the plunger assembly 45 relative to housing 20 is depicted in FIG. 6A. The upper check valve assembly 50 is in the closed position, such that water W positioned above plunger 45 is being raised into the drop pipe 14 and elevated toward the ground surface. At the same time, the lower check valve assembly 35 is open and draws water W residing in the casing 13 into the housing 20. In the combined balance valve and bearing 55, the water pressure in relief ports 66 and the compression springs 74 maintain the relief valves 70 in the closed position depicted. The pressure exerted by the water W being raised by balance valve 55 opens the flapper valves 61, such that the water pressure in annular channel C is transferred to annular channel C' to maintain the flexible sleeve 86 in a pressurized condition in engagement with the inner walls of the housing 20 and the support tube 76 and to accommodate the increasing volume in channel C' due to the convolution 90 moving upwardly at substantially one-half the speed and distance of the plunger assembly 45 carrying balance valve 55. In this fashion, substantially friction-free operation of the sealing assembly 85 is achieved. On the downstroke depicted in FIG. 6B, the plunger assembly 45 is essentially displaced through the column of water W drawn into housing 20 through lower check valve assembly 35 during the prior upstroke of the plunger assembly 45. At the commencement of the downstroke, the lower check valve assembly 35 closes due to pressure created by downward movement of plunger assembly 45 to preclude the escape of water W from the housing 20. The upper check valve assembly 50 opens to allow free flow of water W from below the plunger assembly 45 to a position above plunger assembly 45. The flapper valves 61 of the balance valve 55 close due to the pressure created in annular channel C' below the balance valve 55 and above the sealing assembly 85. During the initiation of the down stroke, the relief valves 70 are closed; however, relief valves 70 open as soon as the pressure within annular channel C' reaches approximately five psi above the head pressure of the water W. Thereafter, during the downstroke, the relief valves 70 maintain an open or partially open position, permitting an escape of water W through relief ports 66 such as to maintain a pressure differential of approximately two to five psi in annular channel C', which maintains the flexible sleeve 86 of sealing assembly 85 in contact with the inner surface of the housing 20 and the outer surface of support tube 76 to achieve essentially friction-free operation of the sealing assembly 85 during the downstroke.

Relief valves 70 at this time also accommodate the decreasing volume in channel C' due to the convolution 90 moving downwardly at substantially one-half the speed and distance of the plunger assembly 45 carrying balance valve 55.

Figure 7:
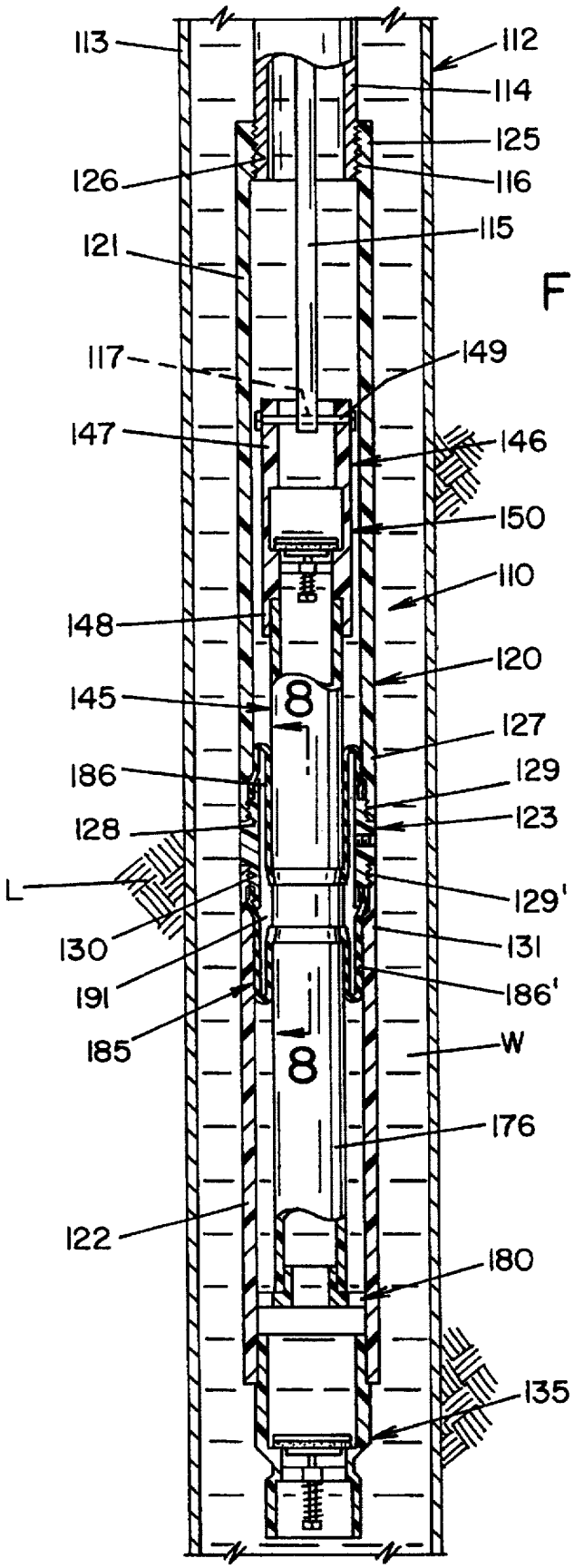
FIG. 7 is a fragmentary longitudinal cross-sectional view similar to FIG. 1 of a pump cylinder showing an alternate sealing assembly configuration according to the concepts of the present invention.

An alternate form of submersible pump cylinder is generally indicated by the numeral 110 in FIG. 7 of the drawings. In a manner similar to submersible pump cylinder 10 of FIG. 1 of the drawings, the pump cylinder 110 is shown for exemplary purposes in a well, generally indicated by the numeral 112. As previously described conventional components, the well 112 has a tubular well casing 113 which extends from the surface of the ground downwardly, normally through a plurality of layers of the earth to, or preferably to substantially the bottom of, a water-bearing layer L. Disposed within and substantially concentrically of the well casing 113 is a conventional drop pipe 114. The drop pipe 114 extends from the well top at the surface of the ground to a position proximate the lower extremity of the well casing 113. Disposed within the drop pipe 114 is a pump rod 115 which similarly extends from the well top of the surface of the ground a distance below the drop pipe 114 within the casing 113. The pump rod 115 is connected in a conventional manner by suitable gearing (not shown) to an electric motor (not shown) or to the pump pole of a windmill (not shown) to produce a desired reciprocating vertical stroke of the pump rod 115 relative to drop pipe 114 and casing 113 to define the stroke of the pump cylinder 110. These components are all standard elements of the exemplary well 112 and the exemplary well 12, as set forth above.

Referring now to FIGS. 7–18 of the drawings, the pump cylinder 110 has as the external member thereof an elongate annular housing, generally indicated by the numeral 120. The housing 120 consists of an upper cylinder barrel 121 and a lower cylinder barrel 122, with an intermediate cylinder barrel 123 interposed therebetween.

The upper cylinder barrel 121 is attached proximate its upper end 125 to the lower extremity of drop pipe 114 as by internal threads 126, which engage mating external threads 116 proximate the lower extremity of drop pipe 114. The upper cylinder barrel 121 has a lower end 127 which has internal threads 128 adapted for selective engagement with external threads 129 of intermediate cylinder barrel 123. The intermediate cylinder barrel 123 has a second set of spaced external threads 129' adapted to matingly engage internal threads 130 proximate the upper end 131 of the lower cylinder barrel 122. It will thus be appreciated that this threaded interconnection of upper cylinder barrel 121, lower cylinder barrel 122, and intermediate cylinder barrel 123 permits disassembly of housing 120 for purposes of repair or replacement of internal components, as well as subsequent reassembly of the housing 120 in the manner shown in FIG. 8.

As can be seen from FIG. 7, the lower end of housing 120 and particularly lower cylinder barrel 122 is selectively opened and blocked by a lower check valve assembly, generally indicated by the numeral 135. The lower check valve assembly 135 is identical to and operates in the same manner as lower check valve assembly 35 described above.

Positioned within and movable relative to the housing 120 is a plunger assembly, generally indicated by the numeral 145 in FIG. 7 of the drawings. The plunger assembly 145 is movable relative to housing 120 by virtue of attachment to the pump rod 115 of the well 112. In particular, the uppermost element of plunger assembly 145 is a hollow annular connector, generally indicated by the numeral 146. The connector 146 has a tubular body 147 that carries a diametrically-disposed pin 149 which engages a bore 117 in the pump rod 115 to thereby attach connector 146 to the pump rod 115 for vertical reciprocating motion therewith.

The plunger assembly 145 has an upper check valve assembly 150 which may be structurally identical to and operate in the manner of the upper check valve assembly 50. The plunger assembly 145 has an elongate, annular support tube 176 which is attached to a downwardly projecting flange 148 of the connector 146. The support tube 176 terminates in a lower bearing 180 which may be identical to lower bearing 80 and functions identically. It is to be noted that the pump cylinder 110, and particularly the plunger assembly 145, does not have structure comparable to the combined balance valve and bearing 55 of the pump cylinder 10.

Figure 8:
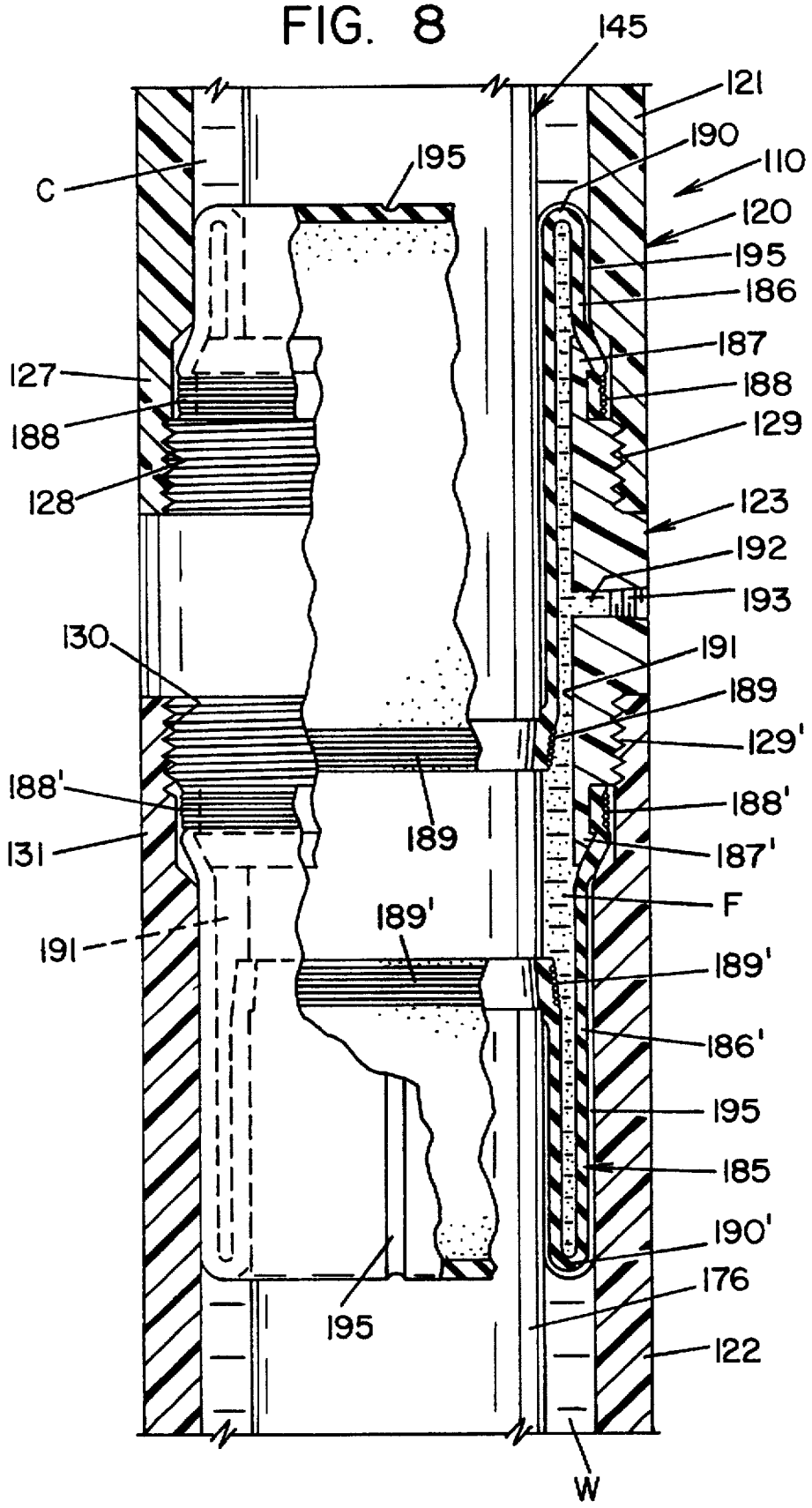
FIG. 8 is an enlarged fragmentary cross-sectional view of the pump cylinder of FIG. 7 taken substantially along the line 8—8 of FIG. 7 and showing details of the construction of the alternate sealing assembly configuration and its attachment to the fixed tube and movable tube members.

The flow of water W between the housing 120 and the plunger assembly 145 is precluded by a sealing assembly, generally indicated by the numeral 185. As best seen in FIG. 8, the sealing assembly 185 has as the primary components thereof a pair of flexible sleeves 186 and 186', each of which is connected to the housing 120 and the plunger assembly 145. The lower end 127 of upper cylinder barrel 121 and the upper end 131 of lower cylinder barrel 122 have projecting barbed flanges 187 and 187', respectively, over which one end of the flexible sleeves 186, 186' are stretched. Outwardly of the flexible sleeves 186, 186' in the area of barbed flanges 187, 187' are clamp rings 188 and 188', respectively, which may be of various available types or, as shown, a continuous wire winding. Second clamp rings 189 and 189' attach the other ends of the flexible sleeves 186, 186' to support tube 176 after the flexible sleeves 186, 186' have been looped into annular channel C to form convolutions 190, 190' in the flexible sleeves 186, 186'. It will be appreciated that the convolutions 190, 190' move longitudinally of flexible sleeves 186, 186' as the plunger assembly 145 strokes upwardly and downwardly relative to the housing 120. The structure of the flexible sleeves 186, 186' may be identical to the structure of flexible sleeve 86 discussed above in conjunction with the pump cylinder 10, including axial grooves 195. In the instance of pump cylinder 110, the flexible sleeves 186, 186' are maintained in a pressurized condition in engagement with the inner walls of the housing 120 and support tube 176 by a fluid F in the annular compartment 191 formed between the sleeves 186, 186'. The compartment 191 has an inlet passage 192 which is selectively opened and closed by plug 193 to inject compartment 191 with the fluid F which is pressurized at approximately two to five psi above the head pressure existing in the water W within housing 120. While air or water could be employed as the fluid F, it may be advantageous to employ a preserving fluid for rubber, such as brey oil or the like, together with a conventional freon refrigerant having a low boiling point in an amount of approximately ten percent by volume to assist in maintaining the pressure within compartment 191 at all times in excess of the pressure of the water W in channel C above and below the sealing assembly 185. In this manner, the flexible sleeves 186, 186' are at all times maintained in contacting relationship with housing 120 and plunger assembly 145 and spaced interiorly to either side of convolutions 190, 190', such as to provide substantially friction-free operation of the sealing assembly 185.

The operation of pump cylinder 110 is identical to that discussed in conjunction with pump cylinder 10, except that pressure balance of the sealing assembly 185 is achieved by compartment 191, with there being no necessity for the structure or operation supplied by the combined balance valve and bearing 55 of the pump cylinder 10. It will be readily appreciated by persons skilled in the art that the sealing assembly 185 could be constituted as a one-piece flexible sleeve rather than the two sleeves 186 and 186' with an intermediate portion affixed to the plunger assembly 145.

It is evident that the submersible pump cylinder disclosed herein carries out the various objects of the invention set forth hereinabove and otherwise constitutes an advantageous contribution to the art. As will be apparent to persons skilled in the art, other modifications can be made to the preferred embodiment disclosed herein without departing from the spirit of the invention, the scope of the invention being limited solely by the scope of the attached claims.

We claim:

1. A submersible pump cylinder for immersion in and displacement of a fluid comprising, a cylindrical housing, a plunger assembly positioned for reciprocating motion within said cylindrical housing, a flexible sleeve attached to said cylindrical housing and to said plunger assembly and overlapped to maintain a convolution which moves during the reciprocating motion of said plunger assembly, and a balance valve associated with said plunger assembly maintaining a selected higher fluid pressure within said convolution of said flexible sleeve, whereby said flexible sleeve is maintained in engagement with said housing and said plunger assembly and substantially without frictional interengagement during motion of said plunger assembly.

2. A pump cylinder according to claim 1, wherein said flexible sleeve is annular and is of substantially uniform diameter throughout its length.

3. A pump cylinder according to claim 1, wherein said cylindrical housing has a first check valve proximate an end thereof, said plunger assembly has a central bore extending the length thereof, and said plunger assembly has a second check valve in said central bore, whereby said first check valve is open and said second check valve is closed upon movement of said plunger assembly in one direction and said first check valve is closed and said second check valve is open upon movement of said plunger assembly in the other direction to effect displacement of the fluid through said plunger assembly.

4. A pump cylinder according to claim 1, wherein said flexible sleeve is attached to said plunger assembly by a first clamp ring and to said housing by a second clamp ring positioned over said flexible sleeve in an area where said flexible sleeve overlies a projecting flange on said cylindrical housing.

5. A submersible pump cylinder for immersion in and displacement of a fluid comprising, a cylindrical housing, a plunger assembly positioned for reciprocating motion within said cylindrical housing, a flexible sleeve attached to said cylindrical housing and to said plunger assembly and overlapped to maintain a convolution which moves during the reciprocating motion of said plunger assembly, and a balance valve associated with said plunger assembly maintaining fluid pressure against said flexible sleeve, whereby said flexible sleeve is maintained in engagement with said housing and said plunger assembly and substantially without frictional interengagement during motion of said plunger assembly, said balance valve having an outer bearing surface for centering said plunger assembly relative to said cylindrical housing.

6. A pump cylinder according to claim 5, wherein said plunger assembly has a lower bearing for centering said plunger assembly relative to said cylindrical housing at a spaced location from said outer bearing surface.

7. A pump cylinder according to claim 5, wherein said bearing surface provides limited clearance with respect to said cylindrical housing and is of sufficient axial extent whereby the fluid passing between said bearing surface and said cylindrical housing is subject to flow resistance.

8. A pump cylinder according to claim 5, wherein said balance valve has a throughbore and associated valving for permitting flow of the fluid therethrough to a channel extending into said overlapped portion of said flexible sleeve during movement of said plunger assembly in one direction and precluding flow of the fluid therethrough during movement of said plunger assembly in the other direction.

9. A pump cylinder according to claim 8, wherein said throughbore and associated valving includes a spring-loaded flapper valve.

10. A pump cylinder according to claim 5, wherein said balance valve has relief porting and related valving for precluding flow of the fluid into said channel during movement of said plunger assembly in one direction and permitting limited flow of the fluid from said channel to maintain a selected pressure differential in said channel during movement of said plunger assembly in the other direction.

11. A pump cylinder according to claim 10, wherein said relief porting and related valving is a spring-loaded ball valve.

12. A cylinder for the displacement of a fluid comprising, a cylindrical housing, a plunger assembly positioned for reciprocating motion within said cylindrical housing, a flexible sleeve attached to said cylindrical housing and to said plunger assembly and overlapped to maintain a convolution which moves during the reciprocating motion of said plunger assembly, and a balance valve associated with said plunger assembly for controlling fluid pressure against said flexible sleeve, whereby said flexible sleeve is maintained in engagement with said housing and said plunger assembly to operate substantially without internal frictional interengagement during the motion of said plunger assembly.

13. A cylinder according to claim 12, wherein said flexible sleeve is annular and is of substantially uniform diameter throughout its length.

14. A cylinder according to claim 12, wherein said plunger assembly has an outer bearing surface diameter providing a limited clearance with said cylindrical housing whereby the fluid passing between said plunger assembly and said cylindrical housing is subject to flow resistance.

15. A cylinder according to claim 12, wherein said balance valve has throughbores communicating with a channel extending into said overlapped portion of said flexible sleeve and valves associated with said throughbores permitting flow of the fluid through said throughbores upon movement of said plunger assembly in one direction and precluding flow of the fluid through said throughbores upon movement of said plunger assembly in the other direction.

16. A cylinder according to claim 12, wherein said balance valve has relief ports communicating with a channel extending into said overlapped portion of said flexible sleeve and valves associated with said relief ports permitting flow of the fluid through said throughbores to maintain a selected pressure differential in said channel during movement of said plunger assembly in one direction and precluding flow of the fluid through said relief ports upon movement of said plunger assembly in the other direction.

17. A cylinder according to claim 12, wherein said flexible sleeve is of substantially uniform diameter and is constructed of sufficiently resilient material such as to roll in a convolution fitting within and movable in an annular channel between said cylindrical housing and said plunger assembly.

18. A cylinder according to claim 17, wherein said sleeve has at least two layers of reinforcing fabric, the fibers of one layer being disposed to one side of the longitudinal axis of said sleeve at an angle of approximately 50 degrees and the fibers of the other layer being disposed to the other side of the longitudinal axis of said sleeve at an angle of approximately 50 degrees.

19. A cylinder according to claim 17, wherein said flexible sleeve has an outer surface with a plurality of axial grooves for permitting the escape of any of the fluid trapped between said flexible sleeve and either of said cylinder housing and said plunger assembly.

20. A cylinder according to claim 17, wherein said plunger assembly has one or more vent holes to permit the escape of any air trapped between said flexible sleeve and said plunger assembly.

21. A cylinder for the displacement of a fluid comprising, a cylindrical housing, a plunger assembly positioned for reciprocating motion within said cylindrical housing, a sealing assembly having two extents of flexible sleeving both attached to said cylindrical housing and to said plunger assembly and overlapped to maintain two convolutions which move during the reciprocating motion of said plunger assembly, each of said two extents of flexible sleeving being annular and of substantially uniform diameter throughout their length, and a compartment formed between said extents of flexible sleeving containing a pressurizing fluid which maintains a selected higher pressure within said sealing assembly, whereby said sealing assembly is maintained in engagement with said housing and said plunger assembly and substantially without frictional interengagement during motion of said plunger assembly.

22. A cylinder for the displacement of a fluid according to claim 21, wherein said cylindrical housing has an inlet passage between said extents of flexible sleeving which is selectively opened and closed by a plug for injecting and maintaining said pressurizing fluid in said compartment.

23. A cylinder according to claim 21, wherein said extents of flexible sleeving have at least two layers of reinforcing fabric, the fibers of one layer being disposed to one side of the longitudinal axis of said flexible sleeving at an angle of approximately 50 degrees and the fibers of the other layer being disposed to the other side of the longitudinal axis of said flexible sleeving at an angle of approximately 50 degrees.

24. A cylinder for the displacement of a fluid comprising, a cylindrical housing, a plunger assembly positioned for reciprocating motion within said cylindrical housing, a sealing assembly having two extents of flexible sleeving attached to said cylindrical housing and to said plunger assembly and overlapped to maintain convolutions which move during the reciprocating motion of said plunger assembly, and a compartment formed between said extents of flexible sleeving containing a pressurizing fluid which maintains pressure within said sealing assembly, whereby said sealing assembly is maintained in engagement with said housing and said plunger assembly and substantially without frictional interengagement during motion of said plunger assembly, said pressurizing fluid including brey oil and a refrigerant.

* * * * *

UNITED STATES PATENT AND TRADEMARK OFFICE

CERTIFICATE OF CORRECTION

PATENT NO. : 5,725,365
DATED : March 10, 1998
INVENTOR(S) : Fred D. Solomon, Charles S. Solomon, and Dale F. Solomon It is certified that error appears in the above-identified patent and that said Letters Patent is hereby corrected as shown below:

Column 11,
Line 21, between "assembly" and "maintain-", insert -- for --.
Line 22, "higher" should read -- increased --.

Column 13,
Line 26, "higher" should read -- increased --.

Signed and Sealed this

Twenty-sixth Day of February, 2002

*Attest:*

*Attesting Officer*

JAMES E. ROGAN
*Director of the United States Patent and Trademark Office*